United States Patent [19]

Horton et al.

[11] 4,040,466

[45] Aug. 9, 1977

[54] INVESTMENT SHELL MOLDING PROCESS

[75] Inventors: Robert A. Horton, Chesterland; Timothy R. Bauer, Richmond Heights, both of Ohio

[73] Assignee: Precision Metalsmiths, Inc., Cleveland, Ohio

[21] Appl. No.: 625,137

[22] Filed: Oct. 23, 1975

[51] Int. Cl.[2] ..... B22C 09/02; B22C 13/08

[52] U.S. Cl. ..... 164/17; 164/161; 164/361; 249/52

[58] Field of Search ..... 164/17, 129, 70, 161, 164/350, 361; 249/52; 229/51 S

[56] References Cited

U.S. PATENT DOCUMENTS

| | | | |
|---|---|---|---|
| 3,338,404 | 8/1967 | Becker et al. | 229/51 S X |
| 3,424,227 | 1/1969 | Watts et al. | 164/36 |
| 3,447,733 | 6/1969 | Smith et al. | 229/51 S X |
| 3,491,907 | 1/1970 | Eelkema | 229/51 S X |
| 3,669,177 | 6/1972 | Ingalls et al. | 164/129 X |

*Primary Examiner*—Ronald J. Shore
*Attorney, Agent, or Firm*—Watts,, Hoffmann, Fisher & Heinke, Co.

[57] ABSTRACT

A method of making investment shell molds by the lost pattern process characterized in that a strand such as wire or the like is wound circumferentially about a pattern assembly in at least one location before it is coated with refractory material to form a mold shell. Thereafter, the strand is unwound to separate the shell into segments, each of which is usable as a mold.

2 Claims, 7 Drawing Figures

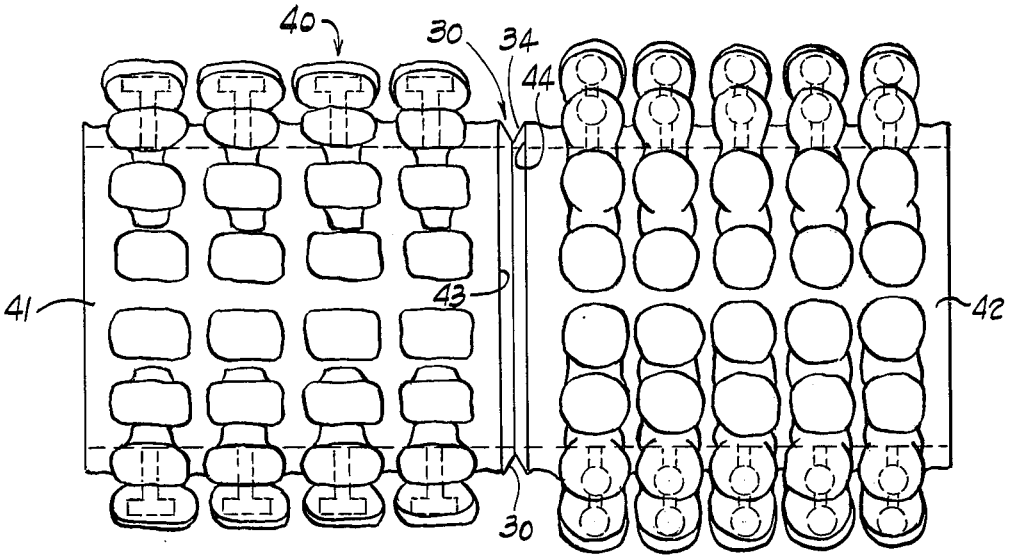
Fig. 4
Fig. 5
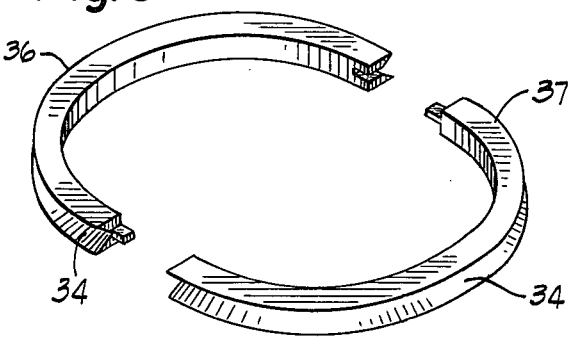
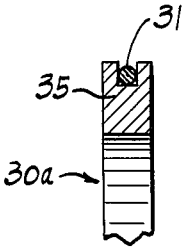
Fig. 6
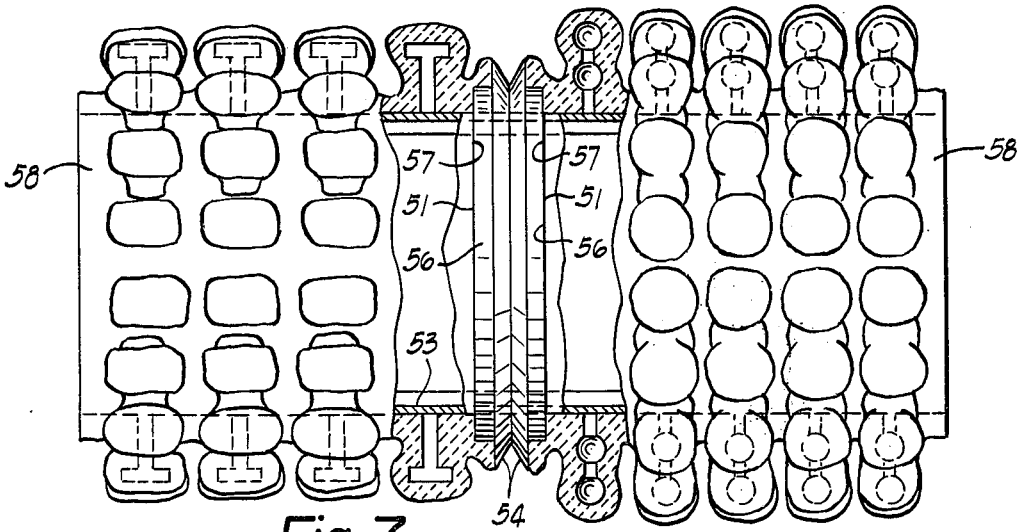
Fig. 7

INVESTMENT SHELL MOLDING PROCESS

BACKGROUND OF THE INVENTION

This invention relates generally to the art of investment casting, and more specifically to ceramic shell molding techniques of investment casting wherein shell molds suitable for casting metal are prepared by building up layers of refractory material around disposable patterns that are subsequently removed from the molds.

Ceramic shell molds are prepared using patterns that are replicas of the parts to be cast and which may include the necessary gates and risers. The patterns are formed of any expendable materials, such as wax or a suitable synthetic resin or blends of wax and resin. These patterns are attached to a central support or sprue member to form what is known as a "set up" or "tree". The formation of a shell mold around the tree is generally accomplished by applying a refractory slurry coating of controlled viscosity followed by directional draining to coat the patterns completely. After draining excess slurry from the tree, the slurry coating is sanded or stuccoed while wet with coarser refractory materials. This layer is hardened, as by forced air drying at room temperature. The result is a layer of ceramic material having refractory particles embedded in the surface. After the first ceramic layer is sufficiently hard and dry, the steps of coating, draining, stuccoing and drying are repeated until a refractory shell having a sufficient thickness to resist the stresses occuring in subsequent operations has been built up around the tree. In a subsequent pattern removable operation, the tree, including the patterns, is removed from the shell mold and it is prepared for the casting operation.

The present invention is an improvement on the invention described and claimed in U.S. Pat. No. 3,424,227 issued Jan. 28, 1969 to C. H. Watts, et al. As disclosed in that patent, a plurality of mold shells are formed in a single operation using one tree. This is accomplished by providing the tree with one or more dividers extending around and projecting radially from the central support or sprue member between its ends. The refractory material used to form the mold shell around the tree is removed from the outer periphery of each divider so that the mold shell is separable into individual sections, each of which is usable to form a mold.

The preferred practice has been to remove the mold material from the dividers after each stucco application before the material has hardened. Prior to hardening, the mold material is soft and wet and can be easily removed by wiping. The disadvantage of this practice is that the wiping operation entails in-process time and requires a work station in the production line. An alternative practice is to remove the hardened mold material from the outside of the dividers by grinding or wire brushing. This can be done after the shell has been formed so as to eliminate special in-process steps during the mold making operation. However, the practice has definite disadvantages in that it usually requires more time and generates objectionable dust.

The development described in U.S. Pat. Nos. 3,812,898 and 3,871,440 issued May 28, 1974 and Mar. 18, 1975, respectively, to Robert A. Horton provides a method and apparatus of coating a plurality of trees or pattern assemblies in a single operation. In the preferred embodiment of that development, the individual trees or pattern assemblies are mounted on a fixture so that they do not individually rotate on their own axis. The arrangement usually makes it impractical to remove the soft, wet mold material from the divider before hardening, since the dividers are not readily accessible. As a result, it has been necessary to resort to the less desirable alternative of grinding or wire brushing the hard mold material from the peripheries of the dividers after the mold making operation has been completed.

SUMMARY OF THE INVENTION

The purpose of the present invention is to provide an improved method of making a plurality of investment shell molds in a single operation using one pattern assembly or tree. More particularly, the purpose of the invention is to provide an arrangement and technique which facilitates separation of a mold shell made in a single operation into individually usable mold sections after the shell has been formed around the tree and the refractory material has hardened.

The process of the invention comprises the steps of winding a wire or other strand around the pattern assembly, applying refractory material to the assembly in the usual manner to form a mold wall that extends over the strand, and thereafter unwinding the strand to separate the mold wall into individual sections.

According to a more specific embodiment of the invention, the improved investment shell molding process comprises the steps of preparing a pattern assembly or a tree which includes a center support having at least one circumferential divider and a plurality of patterns attached to the support, winding a strand around the periphery of the divider, applying refractory material to the pattern assembly in the usual manner to form a mold shell, unwrapping the strand to separate the shell into individual sections which can be used as investment shell molds, and removing the pattern assembly from within the sections.

The new process comprising the use of a wire or other strand in the form of a pull tab wrapped around a tree or pattern assembly permits a mold shell to be quickly and easily separated into sections after the shell has been completely formed and hardened. The separation of the mold shell into sections is accomplished faster and without the objectionable dust involved in grinding or wire brushing operations. The invention is especially useful in applications such as that described in U.S. Pat. No. 3,812,898 where the divider portions of pattern assemblies are not readily accessible for removal of the wet slurry during the mold making operation.

The invention can also be used to advantage in applications where the dividers are accessible for wiping or scraping, but where it is not desirable to carry out such an operation on the production line for reasons of time, space, equipment limitations, etc.

Other advantages and a fuller understanding of the invention will be had from the following detailed description when taken in conjunction with the accompanying drawings.

BRIEF DESCRIPTION OF THE DRAWINGS

FIG. 4 is an elevational view of a mold shell formed around the pattern assembly of FIG. 1;

FIG. 5 is an exploded perspective view illustrating a preferred pattern assembly divider;

FIG. 6 is a fragmentary cross-sectional view of a modified pattern assembly divider; and FIG. 7 is an elevational view partially in cross-section showing still another modified pattern assembly divider used in the process of the present invention.

DESCRIPTION OF THE PREFERRED EMBODIMENTS

Figure 1:
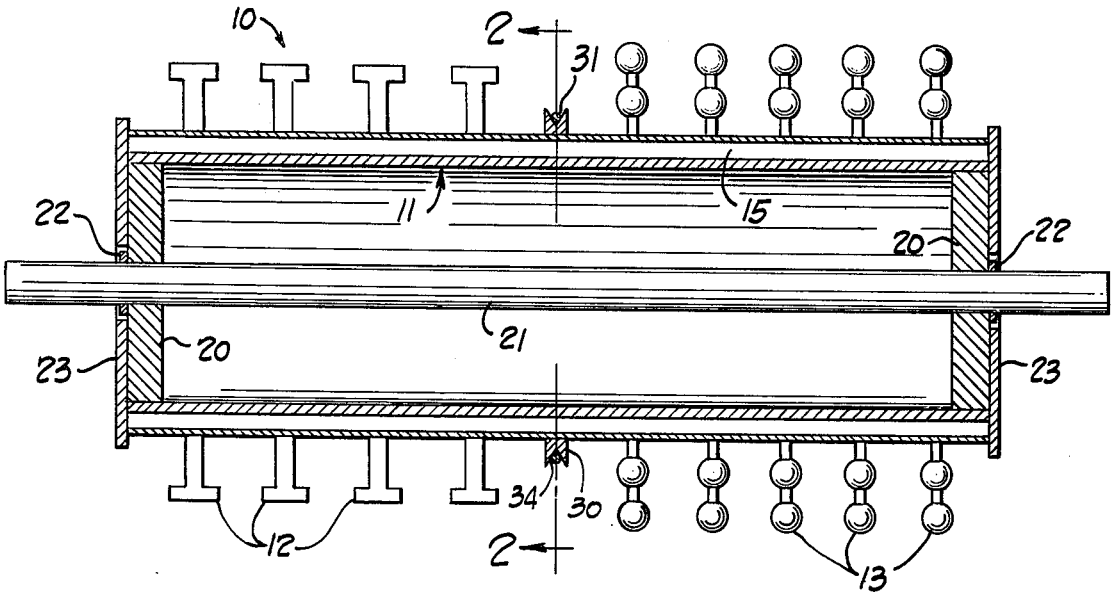
FIG. 1 is a cross-sectional view of an exemplary pattern assembly used in the process of this invention.
Figure 2:
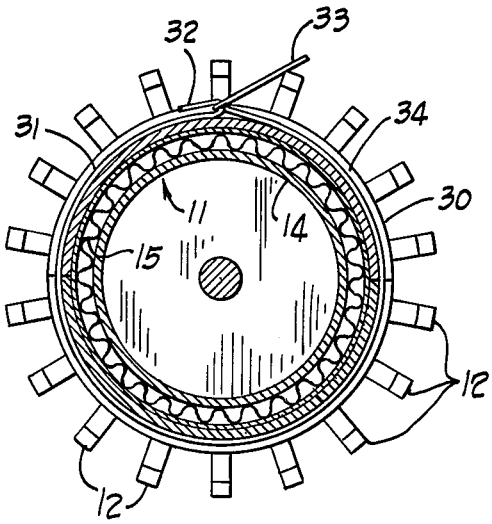
FIG. 2 is a cross-sectional view taken generally on the line 2—2 of FIG. 1.

Referring now to the drawings, and to FIGS. 1 and 2 in particular, there is shown a pattern assembly or tree 10. The tree 10 comprises a central support or sprue member 11 and two groups 12, 13 of patterns attached to the sprue member. The patterns, which are replicas of the parts to be cast in metal and which may include the necessary gates and risers, are formed of an expendable material, such as wax or a synthetic resin or a wax and synthetic resin composition. The two groups of patterns 12, 13 are shown as having a different shape in order to illustrate that molds for different parts can be made by use of a single pattern assembly or tree. It is to be understood that more than two groups of patterns can be attached to the sprue member or that all of the patterns can be identical.

As illustrated, the central sprue member 11 is in the form of a hollow cylinder comprised of a tube 14 made of a cardboard or other relatively stiff material and a corrugated cardboard sleeve 15 which surrounds the tube 14. The sleeve 15 is axially corrugated only in its inner surface while the outer surface of the sleeve is smooth. This structure of the sleeve 15 is such that the tube 14 can be easily removed from the sleeve after the shell forming operations. The smooth outer wall of the sleeve 15 is provided with a thin wax coating that can be applied by rotating the tube and sleeve assembly on a horizontal axis in a molten wax bath. The thickness of the wax coating is sufficient to permit the gate ends of the patterns 12, 13 to be attached to the sprue member 11 by locally heating the wax coating and embedding the gate ends in the softened wax. The thickness of the wax coating typically is in a range of from about 1/32 of an inch to about 1/16 of an inch.

In alternate constructions, the sprue member 11 may be formed by an injection molded or extruded tube of wax or synthetic resin. The sprue member 11 also may be formed by a wax coated metal tube or the like. In still other applications, the sprue member 11 can be solid instead of hollow and of rectangular or other cross-sectional shape.

In order to facilitate handling of the pattern assembly or tree 10, a disc 20 is fitted into each open end of the sprue member 11. A rod 21 extends axially through the assembly 10 and the discs 20 are secured at 22 to the rod by any suitable means. The rod 21 may be provided with a handle (not shown) at one end or with a drive gear (also not shown) so that the set up can be rotated during the shell forming operations. The assembly shown in FIG. 1 also includes annular plates 23 which are suitably secured to the discs 20. The plates 23 project radially beyond the sprue member 11 a sufficient distance to prevent the shell forming material from being built up around the ends of the pattern assembly.

The pattern assembly 10 has at least one divider 30 which extends around and projects radially from the outside of the sprue member 11. The divider 30 is located between the two groups of patterns 12, 13 in order to facilitate the formation of separate shell molds containing each group of patterns in a manner to be described. While only one divider is shown in FIG. 1, it is to be understood that a plurality of axially spaced dividers may be provided along the sprue member 11 in order to form as many separate shell molds as may be desired.

Figure 3:
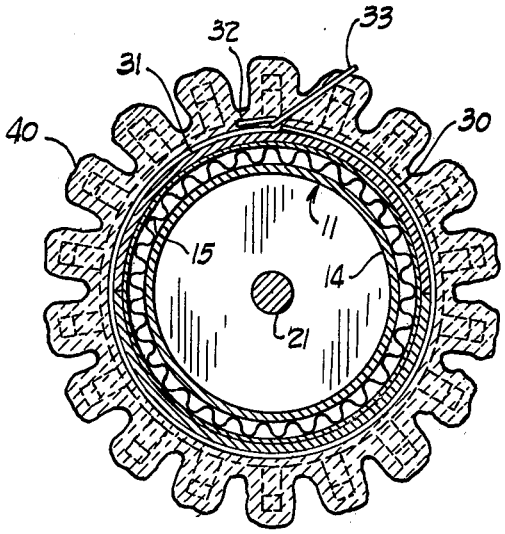
FIG. 3 is a cross-sectional view similar to FIG. 2 but showing the assembly after it has been coated with refractory material to form a mold shell.

In accordance with the present invention, a strand 31 is wrapped around the periphery of the divider 30. One end 32 of the strand 31 is bent back on itself as shown in FIGS. 2 and 3 to form an approximate 180° overlap. The other end portion 33 of the strand 31 is thread through the loop formed by the bent end portion 32 and is pulled tight. The end portion 33 is positioned to extend from the divider 30 at a suitable angle such that the end portion can be conveniently grasped.

The strand 31 can be made of any suitable material such that it can be easily bent to the required configuration and is strong enough to break through the overlying shell material when it is subsequently unwrapped. Any wire made of metal or other material meeting these requirements can be used. Examples of wires that have been successfully employed include steel wire having an approximate diameter of 0.036 inches and insulated bell wire having an approximate diameter of 0.060 inches.

As shown in FIGS. 1, 3 and 4, the divider 30 is formed with a circumferential groove 34 in which the strand or wire 31 is received. In the preferred practice of the invention, the groove 34 is V-shaped with the included angle between the sides of the V ranging from about 60° to about 90°. The V-shaped groove makes it easier to apply the strand or wire 31 to the divider 30 and also helps to align and hold the strand in place so that its plane is perpendicular to the axis of assembly 10. FIG. 6 illustrates an alternate form of a divider 30*a* which has a notch 35 formed with sides that are parallel to the sides of the divider. In still another embodiment of the invention, the groove 34 can be eliminated and the strand 31 wrapped around the outside of a divider such as shown in U.S. Pat. No. 3,424,227.

It is preferred to coat the divider 30 and the strand 31 with a thin layer of wax. The wax serves to prevent refractory slurry from penetrating under the wire or between the wire and the divider itself, thereby assuring cleaner surfaces of separation between the mold shell segments when the strand is unwound and removed from the divider. In instances where dividers do not have circumferential grooves, the wax coating helps to hold the strand in place.

The divider 30 can have a variety of configurations and can be constructed in a number of different ways to suit the needs of particular situations. For example, the divider can be in the form of two half rings 36, 37, as illustrated in FIG. 5, which are mounted around the sprue member 11 and mated together to form a complete ring that projects radially from the outside of the sprue member. The divider can also be in the form of a complete ring which is slipped over the sprue member 11 and secured in place before the patterns 12, 13 are mounted. In alternative embodiments the divider can be a solid disc that separates individual sections of a sprue member. It is also to be understood that dividers carrying the strands 30 can be used in conjunction with sprue members having cross-sectional shapes which are square, triangular, or some configuration other than circular.

In carrying out the invention, layers of refractory slurry and stucco material are applied to the pattern assembly or tree 10, including the divider 30 and the strand 31, in any conventional manner to form a mold shell 40 extending over the strand. After the layers of slurry have hardened and a mold wall having the desired thickness has been produced, the end portion 33 of the strand 31 is grasped with a pair of pliers or the like and pulled. This causes the bent end section of 32 to straighten out and permits the strand to be unwound from the surface of the divider. The unwrapping of the strand 30 is effective to break the overlying mold material so that the mold shell separates into two sections 41, 42, as illustrated in FIG. 4. An important advantage of the V-shaped notch 34 in the divider 30 is that the sharp knife edges formed by the V cause the shell material to break and separate cleanly at the surfaces 43, 44.

After the shell forming operations have been completed, the assembly of the tube 14, the discs 20, the rod 21 and the end plates 23 is removed. When the corrugated sleeve 15 is subsequently slipped from the inside surfaces of the mold sections 41, 42, the mold sections separate to provide individually usable molds. Each mold can then be subjected to a pattern removal operation, such as by placing the molds in a furnace or autoclave, to destroy the patterns 12, 13.

If desired, the divider 30 can have a more complicated cross-section than that previously described in order to impart a particular configuration to the ends of the shell sections formed against it. FIG. 7 illustrates such an embodiment, as shown, a divider 50 is formed by two identical rings 51 which are mated together in a plane perpendicular to the longitudinal axis of the sprue member 53. The rings 51 are provided with flanges 54 that cooperate to form a V-shaped circumferential groove 55. Each of the rings 51 is also formed to have an axially projecting collar or neck portion 56. The collar or neck portions 56 form enlarged end portions 57 in the mold shells 58 suitable for accommodating a core or plug (not shown). The split construction of the divider 50 may be desirable so that each ring 51 will stick in the adjacent mold shell segment and can be melted out in the subsequent pattern removal operation.

Many other modifications and variations of the invention will be apparent to those skilled in the art in the light of the foregoing detailed disclosure. Therefore, it is to be understood that, that within the scope of the appended claims, the invention can be practiced otherwise than as specifically shown and described.

We claim:

1. In a method of making a refractory shell mold, the improvement comprising the steps of preparing a pattern tree including a support member, patterns attached to said support member, and an outwardly projecting divider extending about the said support member, said divider having an outwardly opening, circumferential groove bounded by knife-like edges, wrapping a strand about said divider at the bottom of said groove, applying refractory material to said tree to form a mold shell extending over said divider and embedding said strand, and thereafter unwrapping said strand to separate said shell into sections.

2. A method as claimed in claim 1 wherein said groove is V-shaped.

* * * * *